US011338610B2

(12) United States Patent
Kragt

(10) Patent No.: US 11,338,610 B2
(45) Date of Patent: May 24, 2022

(54) RIBBON DECORATION DEVICE

(71) Applicant: ZEZ Solution, Inc., Denver, CO (US)

(72) Inventor: Saba Kragt, Castle Pines, CO (US)

(73) Assignee: ZEZ SOLUTION, INC., Denver, CO (US)

( * ) Notice: Subject to any disclaimer, the term of this patent is extended or adjusted under 35 U.S.C. 154(b) by 0 days.

(21) Appl. No.: 16/668,856

(22) Filed: Oct. 30, 2019

(65) Prior Publication Data

US 2020/0139749 A1 May 7, 2020

Related U.S. Application Data

(60) Provisional application No. 62/754,766, filed on Nov. 2, 2018.

(51) Int. Cl.
*B44C 3/12* (2006.01)
*A47G 33/08* (2006.01)

(52) U.S. Cl.
CPC ..... *B44C 3/12* (2013.01); *A47G 33/0863* (2013.01)

(58) Field of Classification Search
CPC ..... A47G 33/0863; B44C 3/12
USPC ..... 428/9, 4
See application file for complete search history.

(56) References Cited

U.S. PATENT DOCUMENTS 4,399,171 A * 8/1983 Murray ..... A47G 33/0863 242/388.6
5,523,130 A 6/1996 Sullivan
5,746,504 A 5/1998 Dodson
6,561,674 B2 5/2003 Gibboney, Jr.
6,719,251 B1 4/2004 Eastland et al.
9,895,017 B1 2/2018 Berry

OTHER PUBLICATIONS

Angelica, "Elegant, No-Sew, Roll Up, DIY Linen Window Shade", Jul. 8, 2017, Once Again My Dear Irene, URL: <http://mydearirene.com/2017/07/08/elegant-No. sew-roll-up-diy-linen-window-shade/>, entire document (Year: 2017).*

(Continued)

*Primary Examiner* — Humera N. Sheikh
*Assistant Examiner* — Katherine A Christy
(74) *Attorney, Agent, or Firm* — Trenner Law Firm, LLC; Mark D. Trenner

(57) ABSTRACT

A example ribbon decoration device includes a base structure having a first end, a second end, and a body. At least one end fastener attaches the first end of the base structure to the second end of the base structure for positioning the base structure around a portion of the tree, pole, fixture, window, doorway, or other object. A plurality of decorative ribbons are configurable between a rolled configuration for storage and an unrolled configuration for decorating. Ribbon fasteners are configured to attach a corresponding one of the plurality of decorative ribbons to the body of the base structure. The base structure is positioned on a tree, pole, fixture, window, doorway, or other object with decorative ribbons in the rolled configuration on the base structure, and the decorative ribbons are changed to the unrolled configuration for decorating the tree, pole, fixture, window, doorway, arch, or other object.

9 Claims, 9 Drawing Sheets

(56) References Cited

OTHER PUBLICATIONS

Hollis, "Party Trick: Fringed Streamers", Jul. 17, 2013, Rachel Hollis, URL: <https://msrachelhollis.com/2013/07/17/party-trick-fringed-streamers/#:~:text=Cut%20your%20streamers%20to%20size,hang%20down%20to%20the%20floor.>, entire document (Year: 2013).*

Unknown, "How to keep your ribbon from unrolling", Jun. 23, 2012, Samut Sari, URL: <http://samutsarimisc.blogspot.com/2012/06/how-to-keep-your-ribbon-from-unrolling.html>, entire document (Year: 2012).*

Stephanie, "How to Criss Cross Ribbons on a Christmas Tree," Jan. 17, 2017, Holidappy, URL <https://web.archive.org/web/20170710162258/https://holidappy.com/holidays/criss-cross-ribbon-christmas-tree>, entire document (Year: 2017).*

* cited by examiner

RIBBON DECORATION DEVICE

BACKGROUND

Ribbons are often used for decoration and to decorate for holidays or special events (e.g., birthday parties, weddings, etc.). Ribbons are typically provided on individual cardboard or plastic rolls that need to be cut to length. Stringing these ribbons for decorating requires each roll of ribbon be unrolled, cut to the desired length, and then placed where desired for decoration. Although ribbon decorations are aesthetically pleasing, this sort of decorating can be tedious and time-consuming. The ribbons are typically disposed of after each use because there is no effective way to store the ribbons without the ribbons becoming tangled.

DETAILED DESCRIPTION

Figure 1:
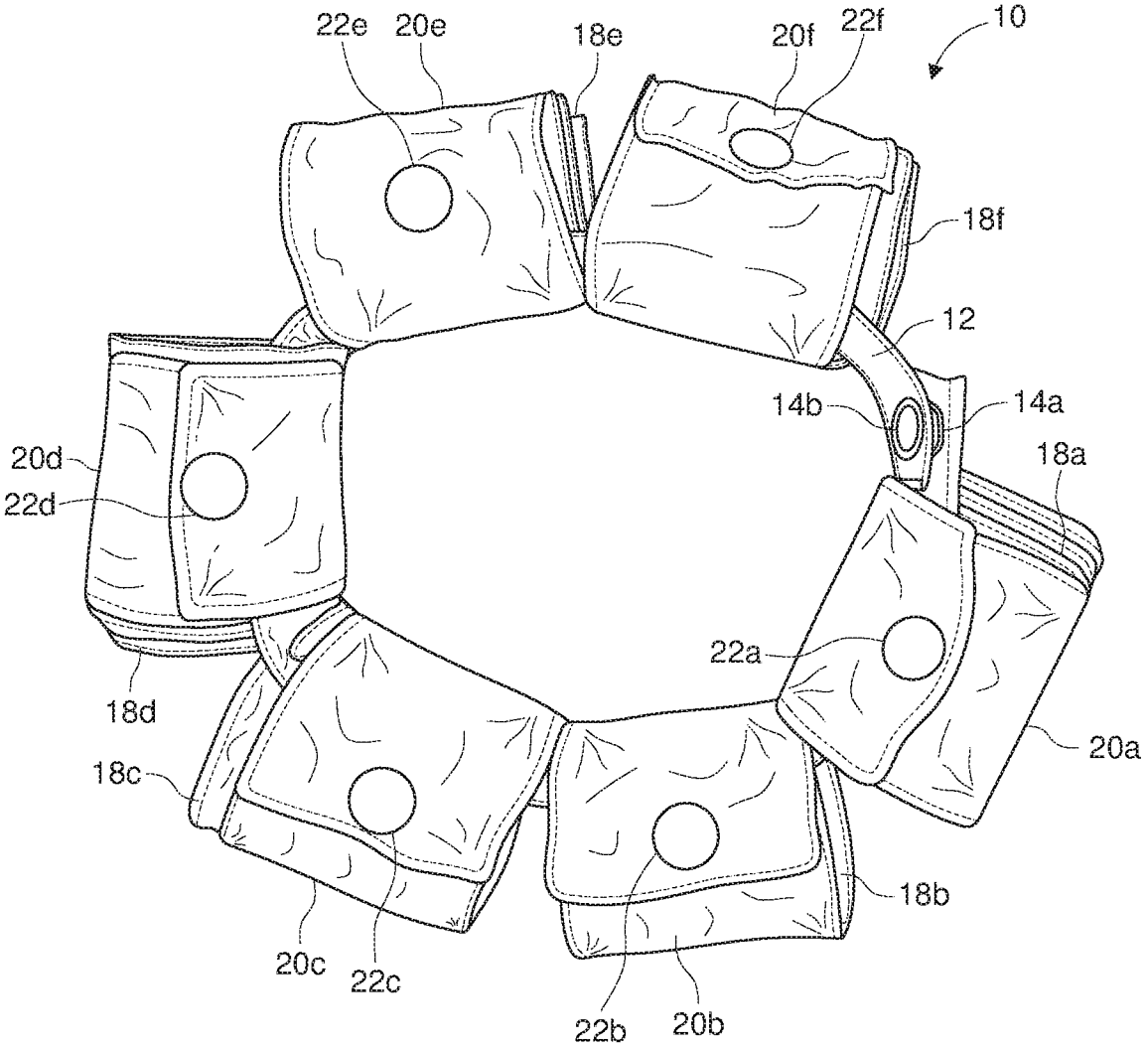
FIG. 1 is a perspective view of an example ribbon decoration device in a closed configuration.

A ribbon decoration device is disclosed. In an example, the ribbon decoration device provides an easy, user-friendly system for decorating with one or more ribbons, and can be employed to decorate a variety of structures (e.g., poles, columns, trees, chandeliers, etc.). Although shown and described herein for purposes of illustration as decorating a Christmas tree, the device can also decorate any object(s) for any occasion (e.g., weddings, birthdays, graduations, Christmas, New Year's Eve, Easter, Valentine's Day, Halloween, Thanksgiving, etc.).

In an example, one or more decorative ribbon or ribbons are attached to a base structure. The ribbons may be rolled and temporarily fastened (e.g., by removable attachment (e.g., snaps, studs, pins, stitching, sewing, hook-and-loop). The rolled ribbons may be attached to the base structure (e.g., a base structure) by any of permanent attachment (e.g., stitching, adhesive) or removable attachment (e.g., snaps, studs, pins, stitching, sewing, hook-and-loop or VELCRO™, etc.).

The decorative ribbons and base structure may be any of a wide variety of materials, designs, patterns, size, length, width, quantity, or quality, etc. The decorative ribbon which streams down from the base structure may also include attachments to attach additional decorations and ribbons. For example, other decorations may be provided to change the theme of the ribbon (e.g., from birthday to holiday) by removing and adding decorations (e.g., birthday cake buttons to wreaths) to the ribbon. The decorative ribbon which streams down from the base structure may also include attachments to lengthen and shorten the decorative ribbon or ribbons to provide for a continuous flow in decorating. Other decorations may also be attached to the ribbon(s) and/or the base structure.

In an example, the ribbon decoration device may be designed to fit 6 to 12 foot structures such as columns, poles and Christmas trees for the mainstream market. However customization may allow the ribbon decoration device to fit larger or smaller structures, trees, buildings, or other items. The decorative ribbon covers may also be implemented as extensions to lengthen the base structure.

The base structure may also be adjustable (e.g., in circumference and/or length) to fit around various sizes poles, columns, trees, or across doors, windows, or on any other structure on which it is installed. The base structure may be customized to attach any number of ribbons, and any width, length, material, style, etc. of ribbons. The ribbons may be mass-produced or custom-made for particular applications.

The ribbon decoration device provides an easy, user friendly system to use in decorating with one or more ribbons. It can be customized with a wide variety of ribbon types, lengths, widths, colors, styles, quantities, qualities, shapes, and designs.

Before continuing, it is noted that as used herein, the terms "includes" and "including" mean, but is not limited to, "includes" or "including" and "includes at least" or "including at least." The term "based on" means "based on" and "based at least in part on."

Figure 2:
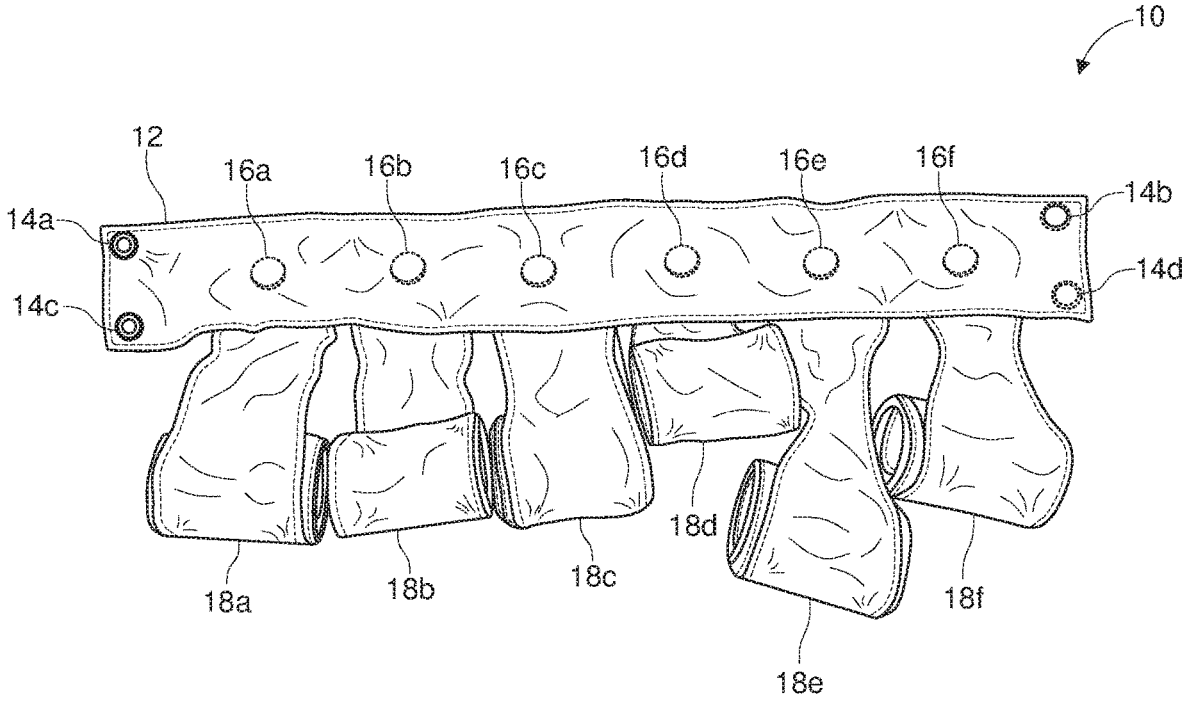
FIG. 2 is a perspective view of the example ribbon decoration device of FIG. 1 in a partially open configuration with several ribbons unfastened and partially unrolled.
Figure 3:
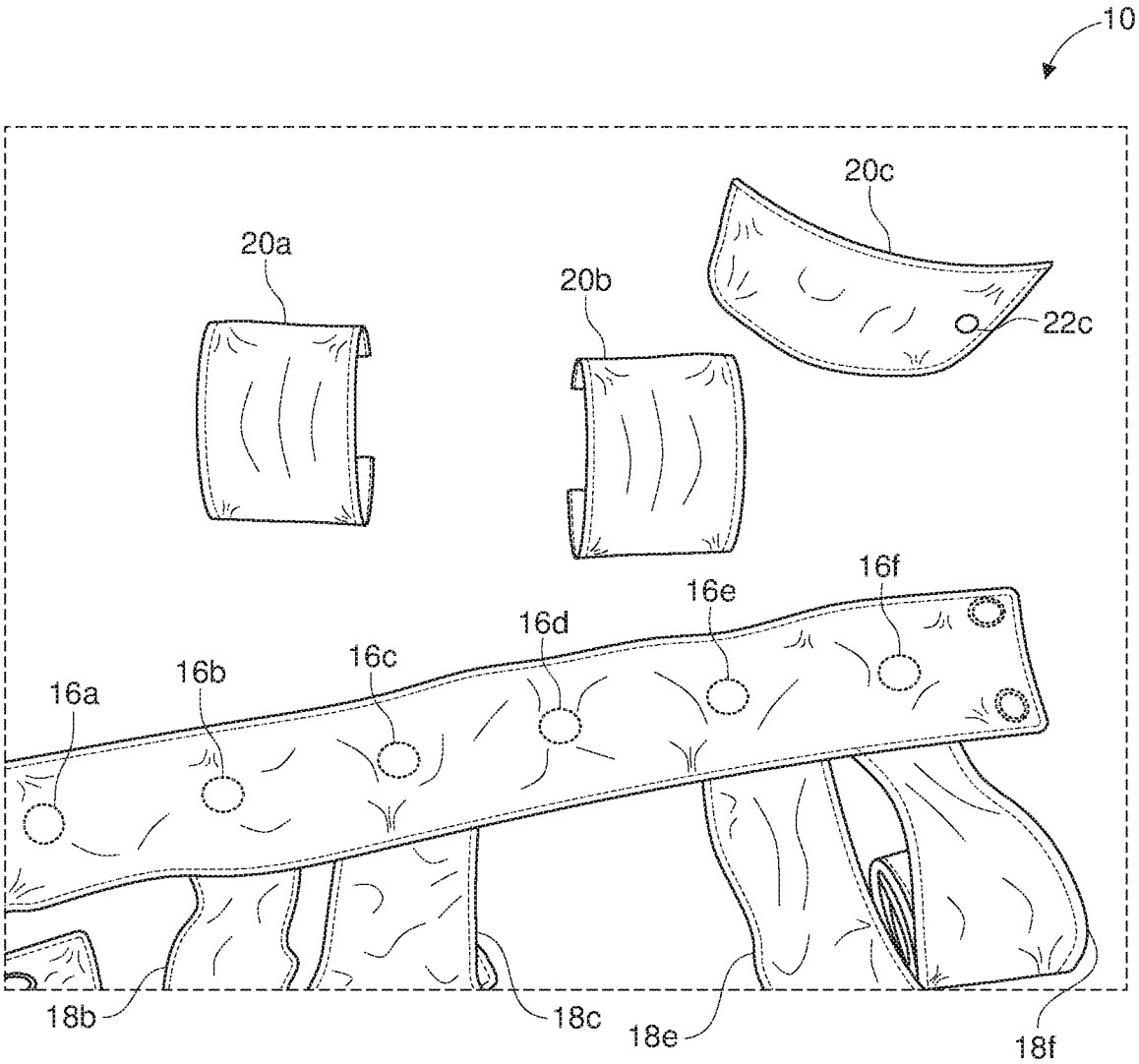
FIG. 3 is a perspective view of the example ribbon decoration device of FIG. 1 with several decorative ribbon covers unfastened and removed from the decoration device.

FIG. 1 is a perspective view of an example ribbon decoration device 10 in a rolled or closed configuration, FIG. 2 is a perspective view of the example ribbon decoration device 10 of FIG. 1 in a partially unrolled or open configuration with several of the ribbons 18*a-f* unfastened and partially unrolled. FIG. 3 is a perspective view of the example ribbon decoration device 10 of FIG. 1 with several decorative ribbon covers 20*a-f* unfastened and removed from the decoration device 10.

An example of the ribbon decoration device 10 includes a base structure 12 having a first end, a second end, and a body. At least one end fastener 14*a-d* is provided on each end of the base structure 12 to attach the first end of the base structure 12 to the second end of the base structure 12. As such, the base structure 12 may be formed as a straight, substantially straight or other layout including closing the ends to form a loop (e.g., circle, square; or other loop).

One or more decorative ribbons 18*a-f* may be removably attached to the body of the base structure 12. In an example, the ribbons 18*a-f* are attached with ribbon fasteners 16*a-f* (e.g.; snaps, hook-and-loop or VELCRO™; etc.). Fasteners 16*a-f* are shown in dashed lines as these may not be visible on the front of the base structure 12. Of course, other attachments may also be provided. In addition; the ribbons 18*a-f* do not need to be removably attached to the base structure 12, and may instead be permanently affixed (e.g., sewn to the base structure 12). The decorative ribbons 18*a-f* are configurable between a rolled configuration for storage and an unrolled configuration for decorating.

In an example, one or more decorative ribbon covers 20*a-f* are provided to retain the decorative ribbons 18*a-f*, respectively, in the rolled-up configuration. In an example, the decorative ribbon covers 20*a-f* are each long enough to fully wrap around a respective one of the decorative ribbons 18*a-f* when in the rolled-up configuration. The decorative ribbon covers 20*a-f* may include cover fastener(s) 22*a-f* to form a closed loop around the decorative ribbons 18*a-f* in the rolled-up configuration and retain the decorative ribbons 18*a-f* therein so that the decorative ribbons 18*a-f* do not unroll while in the rolled configuration.

In the closed or rolled configuration, the base structure 12 can be readily positioned on a tree, pole, fixture, window, doorway, or other object with the decorative ribbons 18*a-f* rolled up. This enables the base structure 12 to be more readily set in position without the ribbons 18*a-f* interfering with placement. After being properly positioned, the ribbon(s) 18*a-f* unrolled for decorating the tree, pole, fixture, window, doorway, or other object.

In an example, the base structure 12 is placed around a portion of the tree, pole, fixture, window, doorway, or other object, with the at least one end fastener attaching the first end of the base structure to the second end of the base structure.

Figure 4:
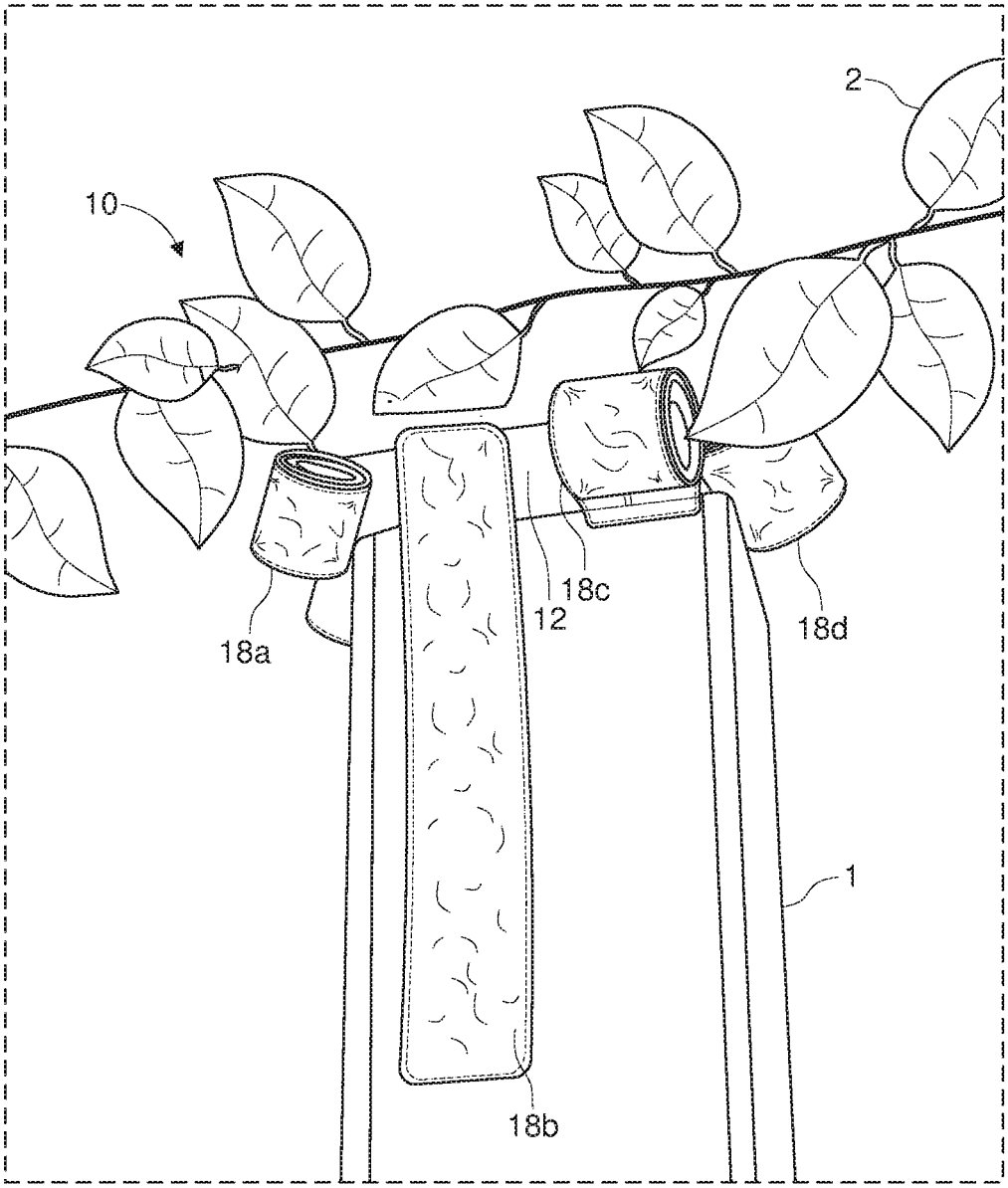
FIG. 4 shows the example ribbon decoration device of FIG. 1 encircling a top portion of a pole or architectural column.

FIG. 4 shows the example ribbon decoration device 10 of FIG. 1 encircling a top portion of a pole or architectural column 1 (e.g., having other decoration such as leaves 2). In an example, after placement and when the user is ready, the decorative ribbon covers 20*a-f* may be opened, and one or more (e.g., all of) the decorative ribbons 18*a-f* unrolled, either straight down the pole or spiraled around it.

The ribbons (e.g., 18*b*) may be attached on the back of the base structure 12 and hang down from behind the base structure. In another example, the ribbons may be attached on the back and loop over the top of the base structure before hanging down. In another example, the ribbons may be attached on the front of the base structure 12.

In an example, the ribbons 18*a-f* may be twisted and/or even tied in fanciful knots or bows. Multiple ribbons may be combined into a composite ribbon(s). Other decorations may also be attached to the ribbon(s) and/or base structure 12. The decorating possibilities are limited only by the desires of the user.

Other examples of the device 10 and its many end-uses are also contemplated. By way of non-limiting illustration, another base structure (the same or similar to base structure 12) may be provided, and each of the base structures connected together to form an extended base structure for use with a larger tree, pole, fixture, or other object. In another illustration, at least two decorative ribbons (e.g., ribbon 18*a* and 18*b* or another ribbon, not shown) may be attached to one another, end-to-end (e.g., directly or via the covers implemented as an interconnection). The combination of the decorative ribbons form an extended length decorative ribbon. In yet another illustration, at least two decorative ribbons may be attached to the base structure 12 at the same point (e.g., 16*a*) and rolled/unrolled together. In another illustration, the decorative ribbons 18*a-f* may be attached on either side of the base structure 12 (e.g., on the front and/or back side) and may hang down or first wrap up and over the base structure before hanging down.

Before continuing, it should be noted that the examples described above are provided for purposes of illustration, and are not intended to be limiting. Other devices and/or device configurations may be utilized to carry out the operations described herein.

Figure 5:
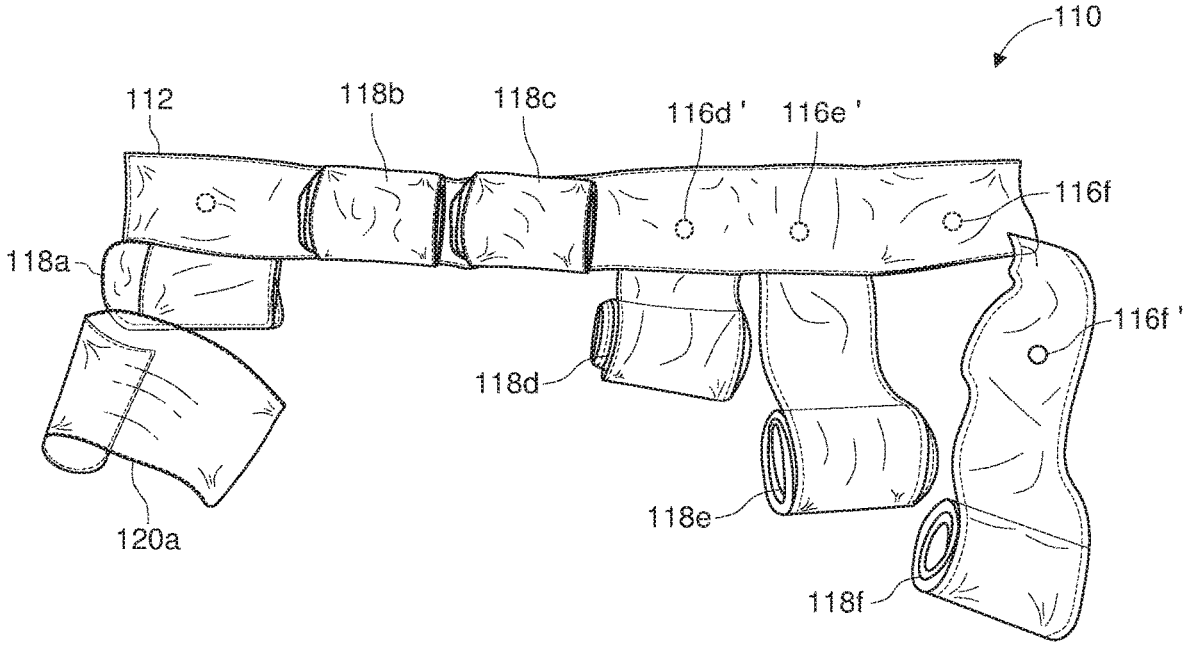
FIG. 5 is a perspective view of another example ribbon decoration device in a closed or partially closed configuration.

FIG. 5 is a perspective view of another example ribbon decoration device 110 in a closed or partially-closed configuration. The ribbon decoration device 110 is similar in that it includes a base structure 112 with one or more end fasteners (not visible in FIG. 5), such that it can be formed in a substantially circular shape or unfastened into a substantially linear shape. In this example, the materials and width of the base structure and ribbons are different than in the previous example. However, its principles of operation, and the effects thereof, are similar. As such, in FIGS. 5-9, 100-series reference numbers are used to refer to similar components as those already described above for FIGS. 1-4, without repeating those descriptions herein.

The base structure 112 includes a plurality of snaps or other ribbon fasteners 116 (ribbon fasteners 116*d*', 116*e*' on the ribbons 118*d* and 118*e*, respectively; and ribbon fasteners 116 and corresponding fastener 116', are visible in FIG. 5). The ribbon fasteners are provided along the length of the body of the base structure 112 and serve as attachment points for one or more decorative ribbons 118*a-f*. The decorative ribbons 118*a-f* may be rolled up and snapped closed in a detachable cover (e.g., cover 120*a* is shown in FIG. 5), such that the ribbon decoration device 110 includes a plurality of decorative ribbons in a secure and compact configuration for storage and positioning the base structure 112 for decoration (e.g., on a tree top).

Once the attachments that secure a decorative ribbon cover 120*a* to the base structure 112 have been unfastened, the decorative ribbon 118*a* may be fully or partially unrolled, or may be removed from the ribbon decoration device 110 as an aesthetic choice.

The covers 120*a* serve a dual purpose that can be used to increase the circumference and length of the ribbons 118*a-f*. For example, the covers 120*a* may optionally be attached between ribbons to one another to form a smaller number of longer ribbons. In an example, the ribbon covers extend and lengthen the base structure and the ribbons that come off of the base structures attach to one another to lengthen the ribbon. In another example, the ribbons and/or base structures may be directly connected to one another. Connection may be by any suitable means, including but not limited to, buttons, snaps, hook-and-loop or VELCRO™, etc.

In another example, the decorative ribbon covers 120*a* may also be used as extensions to lengthen either the base structure 112 or one or more of the decorative ribbons 118*a-f*.

Of course, the devices 10 and 110 described herein are not limited to use with ribbon covers. It is also possible for the decorative ribbons to snap directly to the base structure in a rolled-up configuration, allowing for a coverless design.

Figure 6:
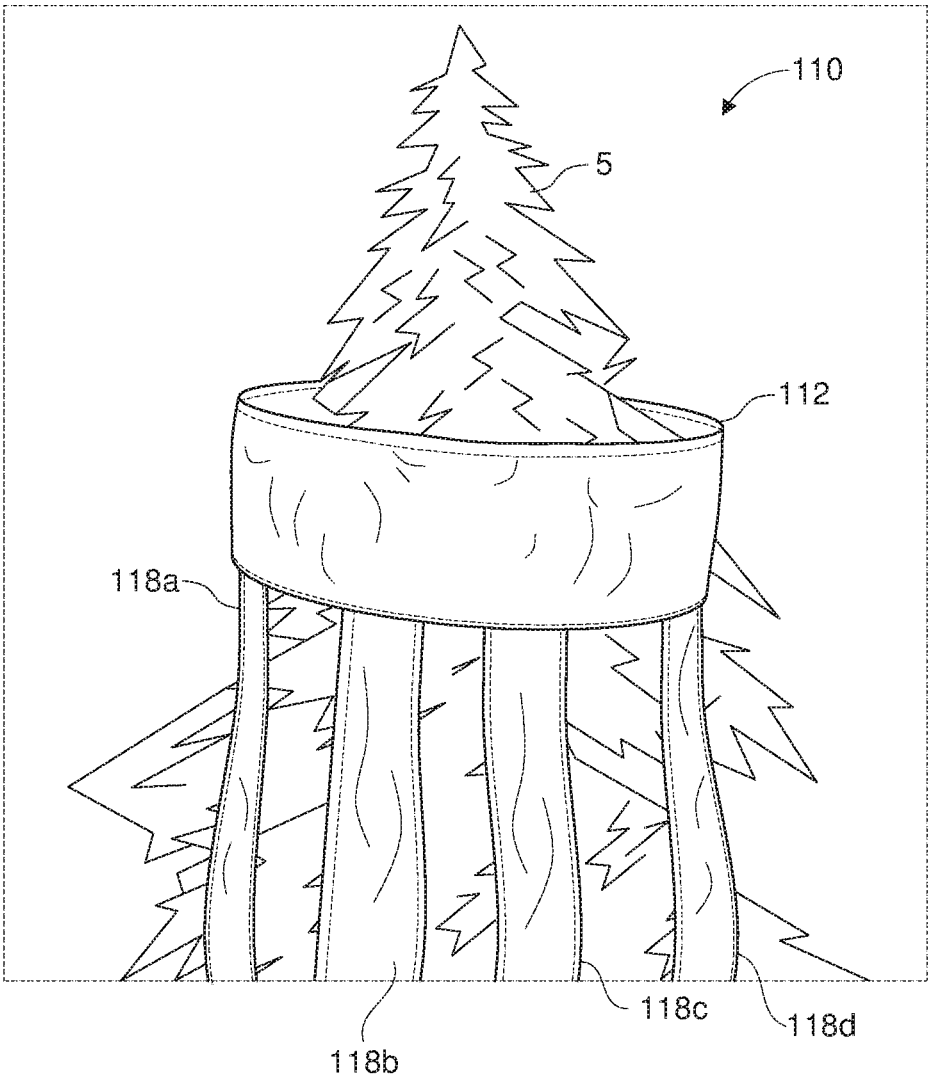
FIG. 6 shows the example ribbon decoration device of FIG. 5 encircling the top of a Christmas tree.
Figure 7:
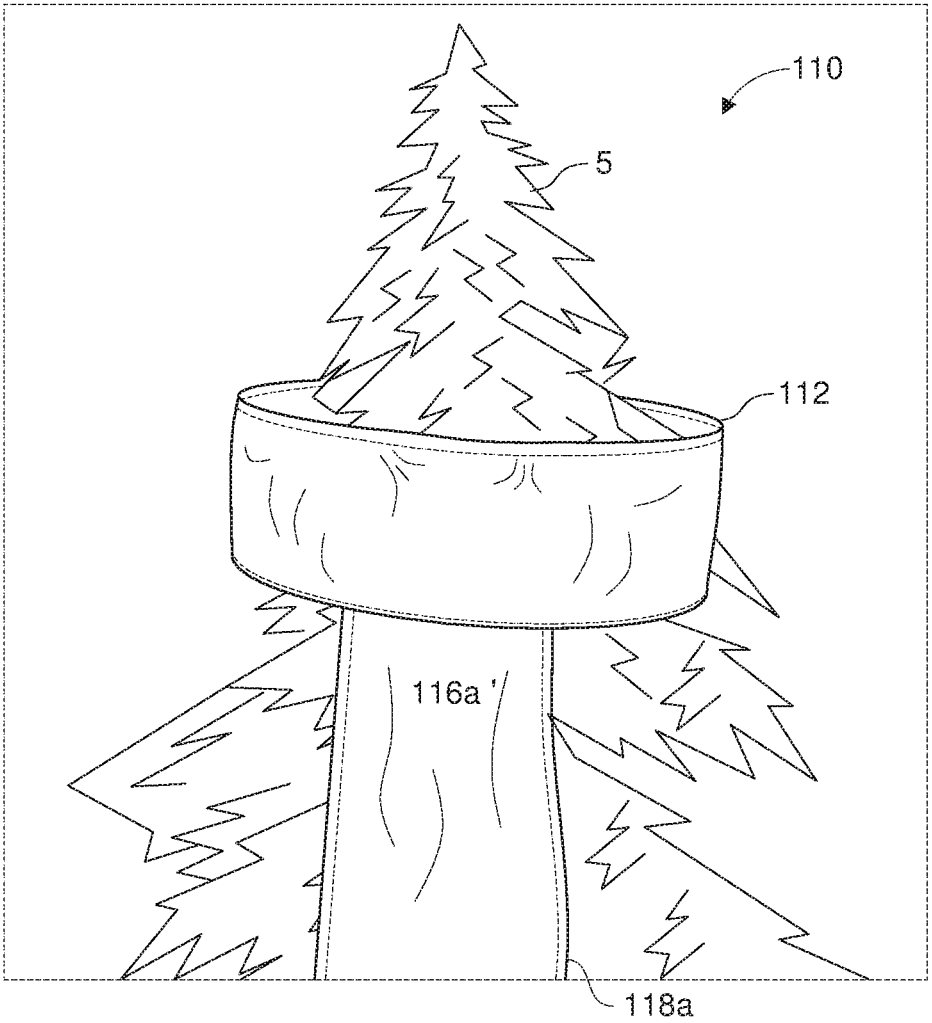
FIG. 7 shows the example ribbon decoration device of FIG. 5 encircling the top of a Christmas tree, with one ribbon unfastened and unrolled.
Figure 8:
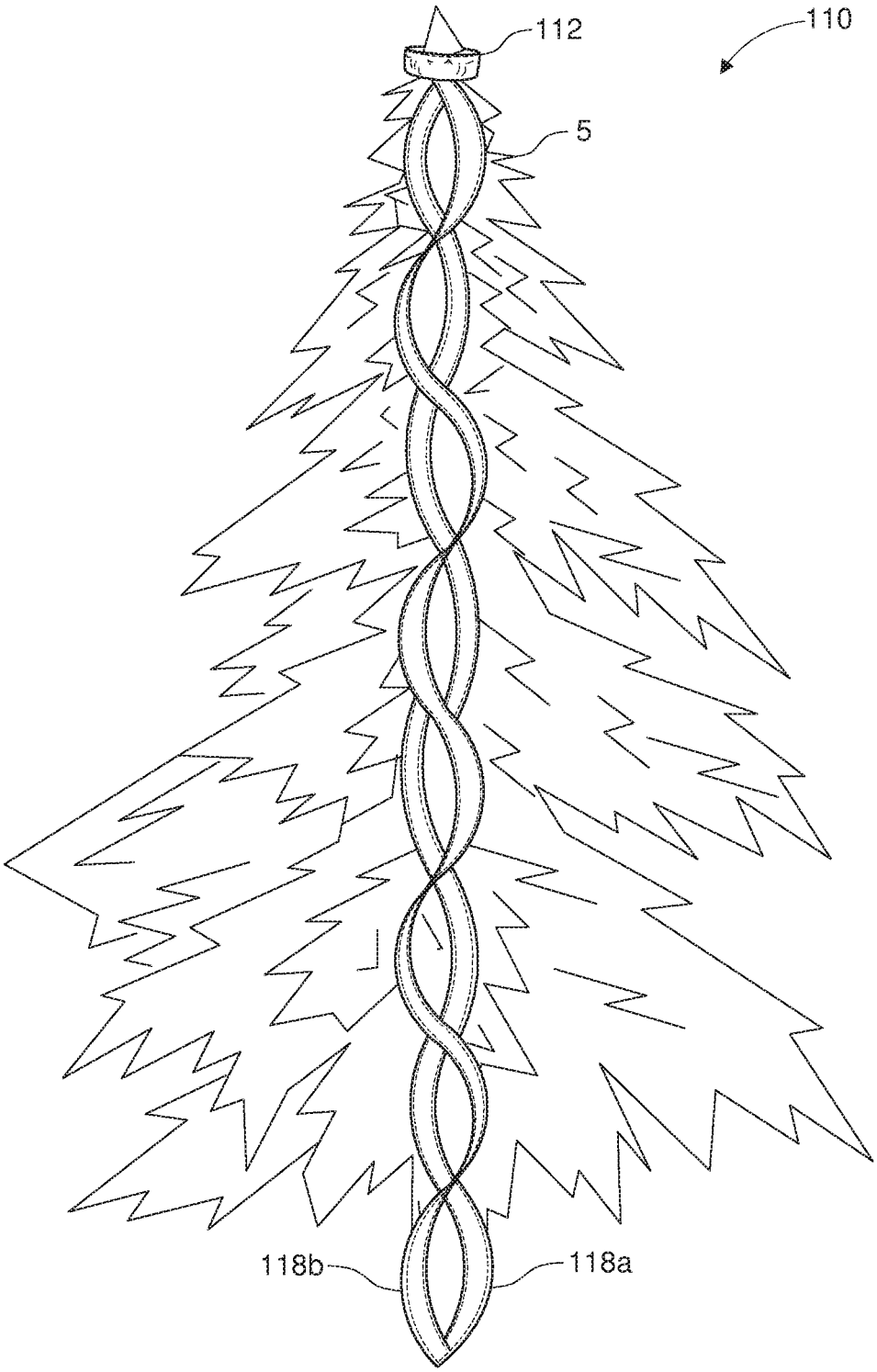
FIG. 8 shows a Christmas tree with a ribbon decoration device encircling its top, and two ribbons unfastened and unrolled.
Figure 9:
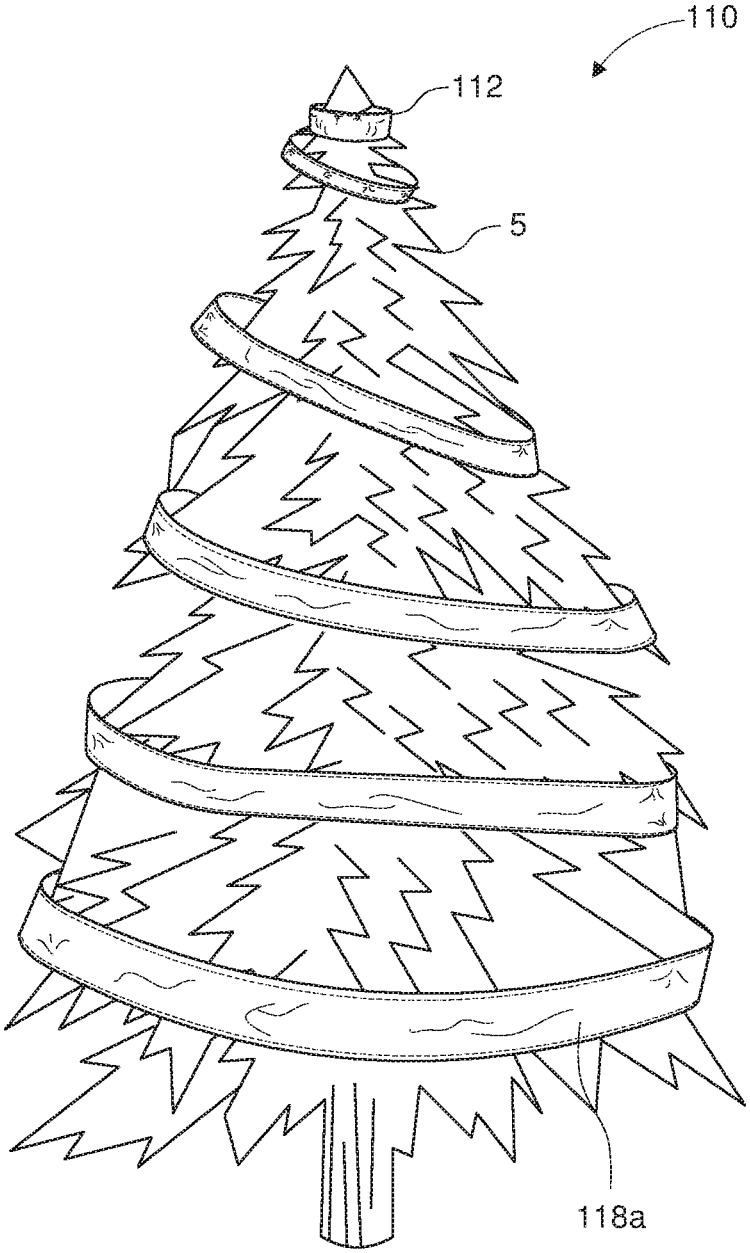
FIG. 9 shows a Christmas tree with a ribbon decoration device encircling its top, and a single ribbon unfastened, unrolled, and wrapped around the Christmas tree.

FIG. 6 shows the example ribbon decoration device 110 of FIG. 5 encircling the top of a Christmas tree 5. FIG. 7 shows the example ribbon decoration device 110 of FIG. 5 encircling the top of a Christmas tree 5, with one ribbon unfastened and unrolled. Additional ribbons 118*a-f* may be attached to provide length and/or volume. FIG. 8 shows a Christmas tree 5 with a ribbon decoration device 110 encircling its top, and two ribbons 118*a* and 118*b* unrolled and twisted together. FIG. 9 shows a Christmas tree 5 with a ribbon decoration device 110 encircling its top, and a single ribbon 118*a* unrolled and wrapped around the Christmas tree 5. In an example, a single ribbon may be used, or multiple ribbons may be attached to one another to form a longer combined or composite ribbon (e.g., of the same or similar texture, color, style, etc., or even different textures, colors, styles, etc.).

In an example, gravity and/or manual force may have unrolled the decorative ribbon(s), such that it reaches downward along the exterior of the Christmas tree 5 for most of the height of the Christmas tree 5, though not so far that it actually touches the floor. Although it may also touch the floor if desired.

As an aesthetic choice, a user may unroll some, all or none of the decorative ribbons 118*a-f* in order to decorate a plant such as a Christmas tree 5 or other object.

The decorative ribbon(s) 118*a-f* may each be a single long ribbon, or may be a composite ribbon made by attaching multiple decorative ribbons together as described above.

As an aesthetic choice, a user may deploy the decorative ribbons 118*a-f* vertically along the outside of the tree 5 or other object. Or the user may wrap the ribbons 118*a-f* around the outside of the tree 5 or other object. Or the user may entwine the ribbons 118*a-f* with the branches of the tree 5 or other object. Still other examples are contemplated in which the user may deploy the ribbons 118*a-f* according to decorative and/or creative techniques.

As will readily be appreciated by a practitioner of ordinary skill in the art after understanding the teachings herein, the ribbon decoration device 10, 110 reduces the labor and skill required to deploy ribbons as decorations (e.g., holiday decorations), and also the labor, skill, and storage space required to retrieve and store the decorations after use. The device is readily manufacturable.

In its various examples and uses, the ribbon decoration device 10, 110 provides a system and method for decorating with ribbon in a manner not previously possible. It provides a system and method that is easily manufactured and used in a variety of different ways. It also provides interchangeability of the number of ribbons to be used, along with their shape, length, width, color, and/or design, which provides a wide range of choices of methods and devices that can be used in decorating with ribbons. It allows for numerous possibilities to use ribbon in decorating. It is a unit that allows for quick and easy decorating using ribbon.

The decorative ribbon or ribbons may be attached or affixed to a base structure at the top of structures such as poles, columns, trees, buildings, windows, doorways, or other such objects (e.g., bridal arches and fixtures) in any desired manner. The decorative ribbon may be attached circumferentially, linearly (diagonally, horizontally, and/or vertically), or on or around any other shape structure.

The decorative ribbons may be attached to the base structure using snaps, studs, pins, clips, hook-and-loop or VELCRO™, stitching, sewing, or other attachment methods known in the art.

The decorative ribbons which stream down from the base structure at the top may provide an attachment at the far end or bottom end that can be employed to attach two or more decorative ribbons to one another in order to lengthen and shorten the ribbon/ribbons to provide for a continuous flow in decorating.

The structural and decorative ribbons may be made from a variety of materials and in a variety of colors and textures, and may or may not match one another. The attachments may be shaped, colored, and/or sized such that they are inconspicuous, or they may be shaped, colored, and/or sized such that they have decorative value as part of the ribbon decoration device.

The operations and elements shown and described herein are provided to illustrate example implementations. It is noted that the operations and elements are not limited to the ordering shown, Still other operations and elements may also be implemented.

Still further operations and elements may include an elastic base structure. The colors and design of the ribbons and/or decorations may be selected for celebrations (e.g., weddings, birthdays, etc.) or organizations (e.g., sports teams, schools, etc.).

It is noted that the examples shown and described are provided for purposes of illustration and are not intended to be limiting. Still other examples are also contemplated.

The invention claimed is:

1. A ribbon decoration device, comprising:

a base structure having a first end, a second end, and a substantially rectangular shaped body, the base structure having a first disconnected configuration and a second connected configuration to form a continuous loop of the base structure;

a first end fastener mounted on the first end of the base structure and connecting the first end of the base structure to a second end fastener on the second end of the base structure to form the continuous loop in the second connected configuration;

decorative ribbons extending from a rolled up configuration on the base structure for storage to an unrolled configuration hanging from the base structure for decorating;

a plurality of first ribbon attachments mounted on the base structure; and a plurality of second mating ribbon attachments corresponding to the plurality of first ribbon attachments, the plurality of second mating ribbon attachments mounted on each of the decorative ribbons, the first ribbon attachments removably connected to the second mating ribbon attachments to attach the decorative ribbons to the body of the base structure;

wherein the plurality of first ribbon attachments and the plurality of second mating ribbon attachments are at least one of adhesive, stitching, snaps, studs, pins, and hook-and-loop; and wherein the base structure is positioned on a tree, pole, fixture, window, doorway, or other object with the decorative ribbons in the rolled-up configuration, and wherein the decorative ribbons are changed to the unrolled configuration for decorating the tree, pole, fixture, window, doorway, arch, or other object.

2. The ribbon decoration device of claim 1, wherein the first end of the base structure is attached to the second end of the base structure and the base structure is placed around a portion of the tree, pole, fixture, window, doorway, or other object.

3. The device of claim 1, wherein decorative ribbons are in the unrolled configuration to hang substantially vertically.

4. The device of claim 1, wherein the decorative ribbons are in the unrolled configuration and wrapped or spiraled around the tree, pole, fixture, or other object.

5. The device of claim 1, further comprising one or more substantially rectangular decorative ribbon cover to wrap around and connect to itself, the decorative ribbon cover having a width to substantially cover the one or more decorative ribbon and retain the decorative ribbons in the rolled-up configuration.

6. The device of claim 5, wherein the one or more substantially rectangular decorative ribbon cover is long enough to fully wrap around and substantially cover decorative ribbons in the rolled-up configuration.

7. The device of claim 6, wherein the one or more substantially rectangular decorative ribbon cover includes a cover fastener forming a closed loop around the decorative ribbons in the rolled-up configuration and retaining the decorative ribbons therein so that the one or more decorative ribbon does not unroll while in the rolled-up configuration.

8. The device of claim 1, further comprising another base structure, each of the base structures connected together via ribbon cover to form an extended base structure.

9. The device of claim 1, further comprising at least two decorative ribbons attached to one another as an extended length decorative ribbon.

* * * * *